US007726268B2

(12) United States Patent
Kelem et al.

(10) Patent No.: US 7,726,268 B2
(45) Date of Patent: Jun. 1, 2010

(54) SIX STROKE INTERNAL COMBUSTION ENGINE AND METHOD OF OPERATION

(76) Inventors: Howard Kelem, 13664 Kiltie Ct., Delray Beach, FL (US) 33446; Estelle Kelem, 13664 Kiltie Ct., Delray Beach, FL (US) 33446

( * ) Notice: Subject to any disclaimer, the term of this patent is extended or adjusted under 35 U.S.C. 154(b) by 0 days.

(21) Appl. No.: 12/288,549

(22) Filed: Oct. 20, 2008

(65) Prior Publication Data

US 2010/0095913 A1 Apr. 22, 2010

(51) Int. Cl.
*F02B 75/02* (2006.01)

(52) U.S. Cl. ..... 123/64

(58) Field of Classification Search ..... 123/64
See application file for complete search history.

(56) References Cited

U.S. PATENT DOCUMENTS 1,091,703 A * 3/1914 Pratt ..... 123/21
1,913,399 A * 6/1933 Krug ..... 123/64
4,367,700 A * 1/1983 Pace ..... 123/64

FOREIGN PATENT DOCUMENTS

FR 2547625 A * 12/1984
GB 2366326 A * 3/2002

* cited by examiner

*Primary Examiner*—Noah Kamen
(74) *Attorney, Agent, or Firm*—Robert M. Downey, PA

(57) ABSTRACT

An internal combustion engine includes an arrangement of cylinders each having a reciprocating piston operatively linked to a crankshaft. The cycle for each cylinder includes an intake stroke, a compression stroke, a power stroke, an exhaust stroke, and two free strokes during which the exhaust valve or a separate clean air valve is left open. The power stroke of each cylinder fires simultaneously with the free stroke of another cylinder. The engine and method of operation provides a six stroke cycle for each power stroke to yield three revolutions of the crankshaft per cycle, thereby increasing fuel efficiency.

6 Claims, 5 Drawing Sheets

SIX STROKE INTERNAL COMBUSTION ENGINE AND METHOD OF OPERATION

BACKGROUND OF THE INVENTION

1. Field of the Invention

The present invention relates to internal combustion engine operation and, more particularly, to a six stroke internal combustion engine wherein each power stroke fires simultaneously with a free stroke of another cylinder to reduce fuel consumption.

2. Discussion of the Related Art

For many years now, most cars, trucks, motorcycles and other machinery have used a four stroke cycle internal combustion engine as the power source. The primary parts of the combustion engine include a cylinder containing a reciprocating piston that is linked to a crankshaft by means of a connecting rod. Linear reciprocating movement of the piston head within a cylinder is converted into a rotational movement of the crankshaft as a result of the pivotal linkage of the connecting rod between the piston head and a crank cam on the crankshaft. Each cycle of operation in a cylinder includes intake, compression, combustion, and exhaust. The four strokes of a piston during this cycle include an intake stroke, a compression stroke, a power stroke and an exhaust stroke. These four strokes occur during two rotations of the crankshaft per working cycle of the combustion engine. Each cycle begins with the piston at top dead center, when, the piston head is furthest away from the axis of the crankshaft. During the intake stroke, the piston head travels downwardly within the cylinder, increasing the cylinder volume while reducing pressure within the cylinder. At this point, an intake valve is opened to allow injection of a fuel and air mixture into the cylinder. Next, the intake valve closes and the piston travels upwardly within the cylinder through the compression stroke, causing the fuel and air mixture to be compressed towards the top of the cylinder. The fuel and air mixture is then ignited near the end of the compression stroke, and the small explosion of burning gases forces the piston downwardly through a power stroke. In a four stroke gasoline combustion engine, often referred to as an Otto cycle engine, ignition is caused by a spark from a spark plug. During the exhaust stroke, the piston travels upwardly and an exhaust valve at the top of the cylinder is opened to allow the piston head to push the combustion gases out of the cylinder and through an exhaust port. Firing of the spark plugs at each cylinder, to ignite combustion, is operated in a timed sequence so that each cylinder in the four stroke cycle fires at the precise moment when the piston in each of the respective cylinders reaches the top of the compression stroke.

In recent years, the price of fuel has risen significantly. Presently, consumers are paying in excess of four dollars per gallon for regular grade gasoline at commercial gas stations in order to operate their automobiles. Soaring fuel prices have put a definite strain on the typical household budget, and are a major contributing factor in the current economy that may believe to be in a state of recession. Some economists fear that further increases of fuel costs could push the economy into a deeper recession or, possibly, a depression.

An immediate solution to high fuel costs is to improve the fuel efficiency of automobiles. Not surprisingly, hybrid vehicles and high fuel efficiency vehicles are now in high demand. However, the cost to purchase a hybrid or a new, more fuel efficient vehicle is not practical for most consumers. Accordingly, there remains a need for a cost effective means to make existing automobiles more fuel efficient.

The present invention provides an immediate solution by significantly increasing (i.e., by as much as 50%) fuel economy in both new and existing automobiles. Specifically, the present invention adds two free strokes to the conventional four stroke combustion engine for a total of six strokes and three crankshaft rotations for each power stroke.

OBJECTS AND ADVANTAGES OF THE INVENTION

Considering the foregoing, it is a primary of the present invention to provide a six stroke combustion engine that is designed to increase the fuel efficiency (i.e., miles per gallon) of an automobile engine by as much as 50%.

It is a further object of the present invention to provide a six stroke combustion engine that provides one power stroke for three revolutions of the crankshaft.

It is still a further object of the present invention to provide a combustion engine with multiple cylinders, wherein the power stroke of each cylinder fires simultaneously with a free piston stroke of another cylinder, thereby reducing fuel consumption.

It is still a further object of the present invention to provide a six stroke combustion engine that allows for two free piston strokes per cylinder throughout a six stroke cycle, to provide a significant increase in fuel efficiency with minimal loss of power.

It is still a further object of the present invention to provide a six stroke combustion engine, as disclosed herein, that can be easily retro-fitted to an existing four stroke combustion engine.

These and other objects and advantages of the present invention are more readily apparent with reference to the detailed description and drawings.

SUMMARY OF THE INVENTION

The present invention is directed to an internal combustion engine that has an arrangement of cylinders, with each cylinder including a reciprocating piston operatively linked to a crankshaft. The cycle for each cylinder includes an intake stroke, a compression stroke, a power stroke, an exhaust stroke, and two free strokes during which the exhaust valve or a separate clean air valve is left open. The power stroke of each cylinder fires simultaneously with the free stroke of another cylinder. The engine and method of operation provides a six stroke cycle for each power stroke to yield three revolutions of the crankshaft per cycle, thereby increasing fuel efficiency.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
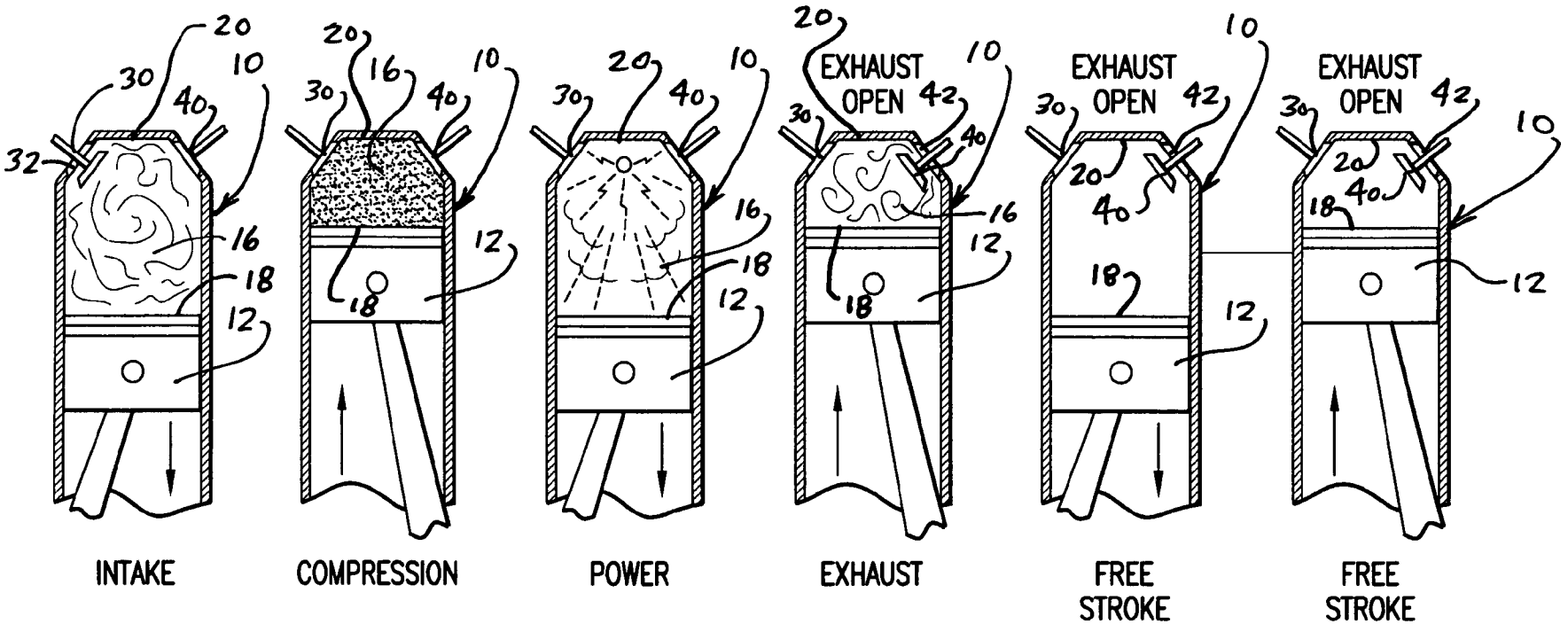
FIG. 1 is a side elevational view, in partial cross-section, illustrating a sequence of operation of a piston and intake and exhaust valves throughout a six stroke cycle in a cylinder of the engine according to the invention.

The internal combustion engine of the present invention includes an arrangement of cylinders 10 each having a reciprocating piston 12 that moves through a six stroke cycle to drive rotation of a crankshaft (not shown). A variable volume combustion chamber 16 is defined between a top surface 18 of the piston head 12 and the cylinder head 20.

Referring initially to FIG. 1, a sequence of operation of the piston 12 through the six stroke cycle in a cylinder 10 is illustrated. During an intake stroke, the piston 12 moves downwardly and an intake valve 30 is opened to allow injection of a fuel and air mixture through an intake port and into the combustion chamber 16. Next, during a compression stroke, the piston 12 moves upwardly and the intake valve 30 is closed, causing the fuel and air mixture to be compressed towards the top of the cylinder as the volume of the combustion chamber 16 is substantially reduced. At the top of the compression stroke, the compressed fuel and air mixture is ignited, such as by a spark plug, causing the fuel and air mixture to combust. The forces of combustion push the piston 12 downwardly in a power stroke to drive rotation of the crankshaft, while the intake valve 30 and an exhaust valve 40 remain closed. On the return upward movement of the piston 12, through an exhaust stroke, an exhaust valve 40 is opened to allow release of the gases of combustion out through an exhaust port 42. Next, the piston 12 is allowed to move through, two free strokes, including a downward free stroke and an upward free stroke. In this particular embodiment, the exhaust valve 40 is maintained open throughout the two free strokes.

Figure 2:
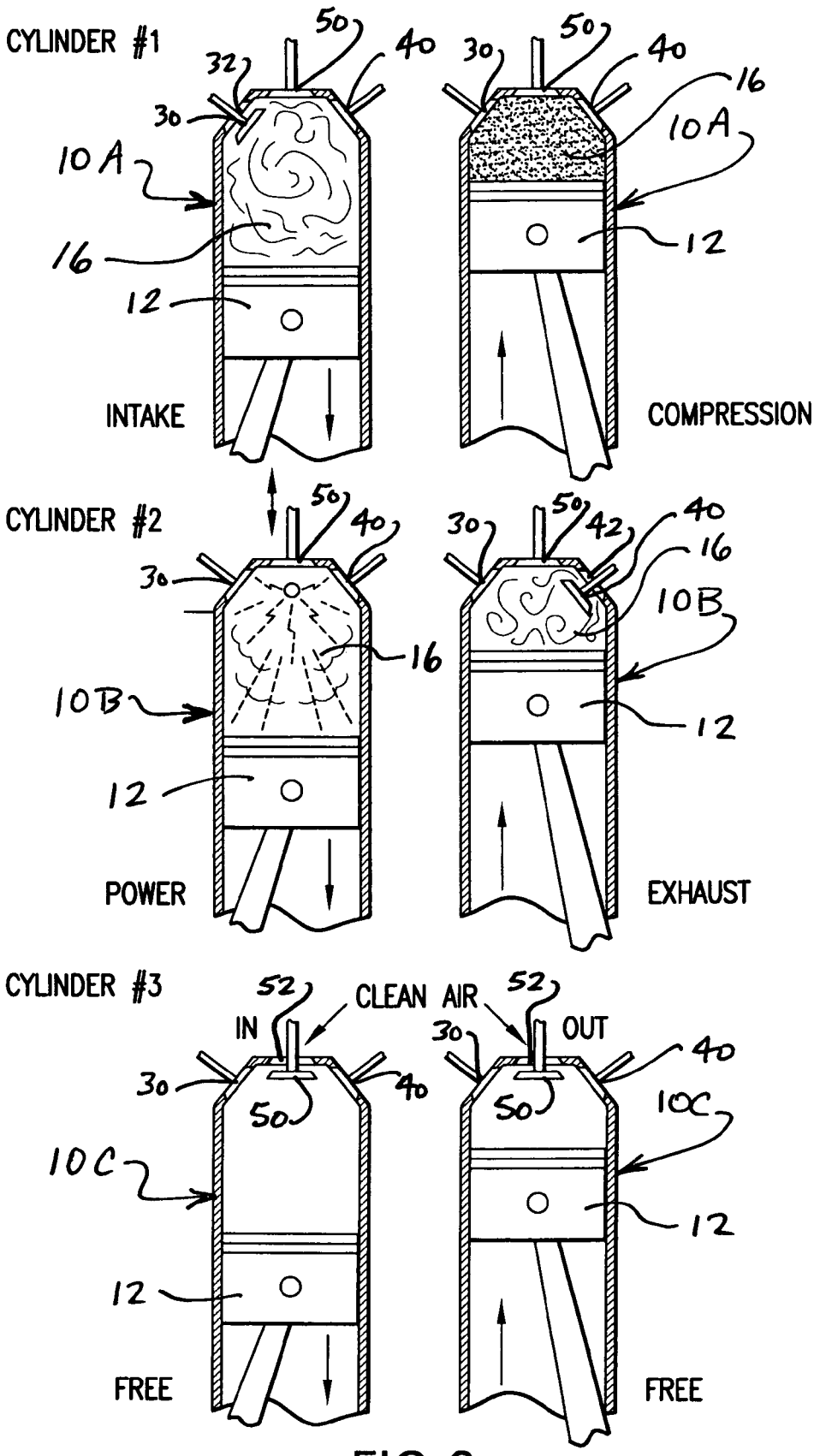
FIG. 2 is an elevational view, in partial cross-section, showing three cylinders operating simultaneously, each at different strokes of the six stroke cycle, according to the method of operation of the engine.

FIG. 2 illustrates simultaneous operation of three cylinders 10A-10C of the engine, each operating in the six stroke cycle, wherein the first cylinder is shown operating through the intake and compression stroke, while the second cylinder 10B operates through the power stroke and the exhaust stroke. The third cylinder 10C is shown operating through the two free strokes, with the three down strokes operating simultaneously with the power stroke of cylinder 2. FIG. 2 also illustrates an alternative embodiment of the valve arrangement on the cylinders. Specifically, each cylinder includes an intake valve 30 associated with an intake port 32, an exhaust valve 40 associated with an exhaust port 42 and a clean air valve 50 associated with a clean air port 52. Referring to cylinder 10A in FIG. 2, the intake valve 30 is opened during the intake stroke, allowing injection of the fuel and a mixture into the combustion chamber 16. Both the intake valve 30 and exhaust valve 40, as well as the clean air valve 50, are closed during the compression stroke. Referring to cylinder 10B in FIG. 2, the intake valve 30, exhaust valve 40 and clean air valve 50 are maintained closed during the power stroke and, during the exhaust stroke, the exhaust valve 40 is opened to allow the gases of combustion to be released through the exhaust port 42. During the two free strokes of the piston, as shown in cylinder 10C of FIG. 2, the clean air valve 50 is opened to allow free movement of the piston head 12 without resistance of compression.

Figure 3:
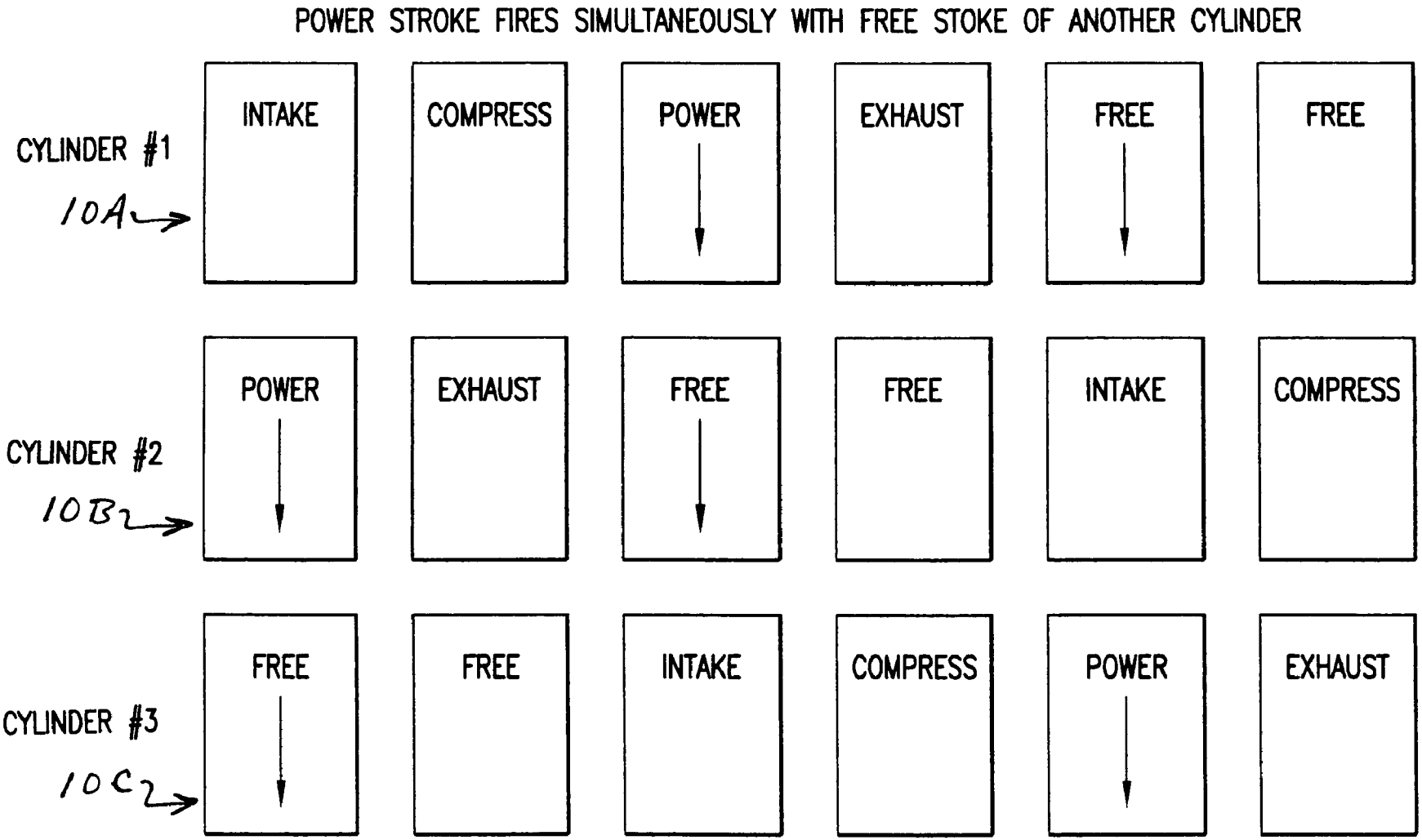
FIG. 3 is a diagram illustrating the simultaneous operation of the six strokes of each cycle in three cylinders of the engine, with a power stroke in each cylinder operating simultaneously with a free stroke in another cylinder.

FIG. 3 presents a diagram demonstrating the simultaneous operation of the pistons 12 in each cylinder 10A, 10B and 10C through the six stroke cycle. As seen with reference to FIG. 3, the power stroke of the piston 12 in any one of these cylinders 10A-10C operates simultaneously with a downward free stroke of a piston 12 in another one of the cylinders. Accordingly, the six stroke cycle for each power stroke yields three revolutions of the crankshaft per cycle. By introducing the two free strokes in each cylinder, an additional rotation of the crankshaft is achieved for each cycle and the fuel consumption of the engine is reduced by approximately fifty percent.

Figure 4:
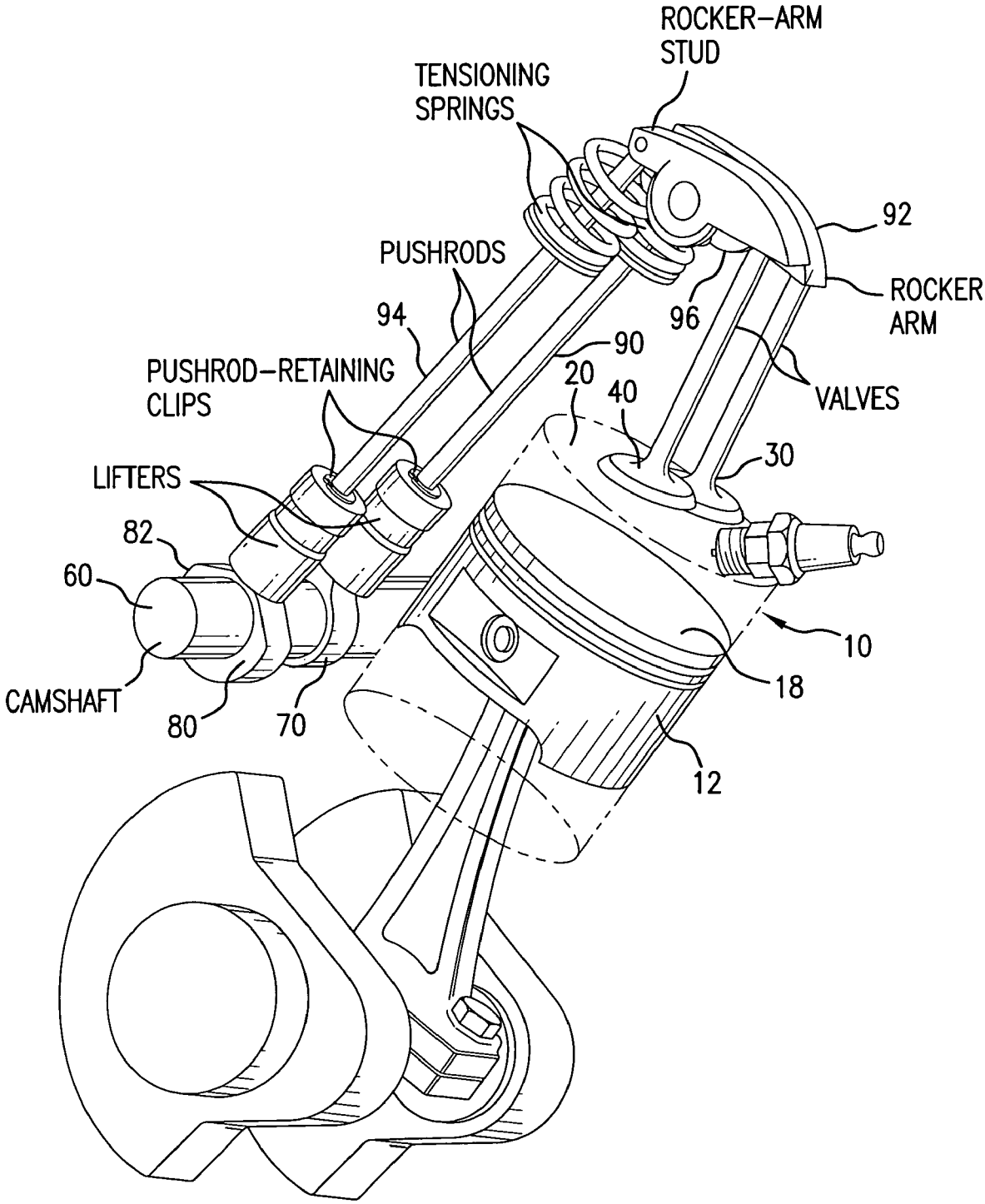
FIG. 4 is a perspective view of a cylinder and valve assembly including a camshaft, pushrods, a rocker arm, intake and exhaust valves, a cylinder and a reciprocating piston for driving rotation of a crankshaft.
Figure 5:
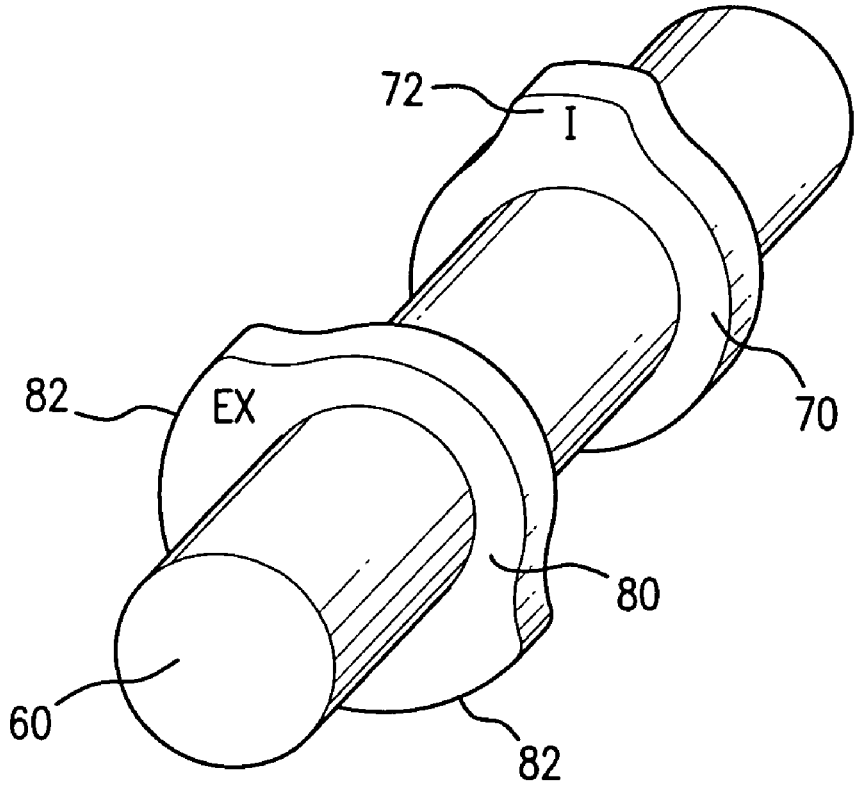
FIG. 5 is an isolated perspective view showing the camshaft and valve cams of the assembly in FIG. 4 for operating the intake and exhaust valves of the cylinder between the open and closed positions throughout the six stroke cycle.
Figure 6:
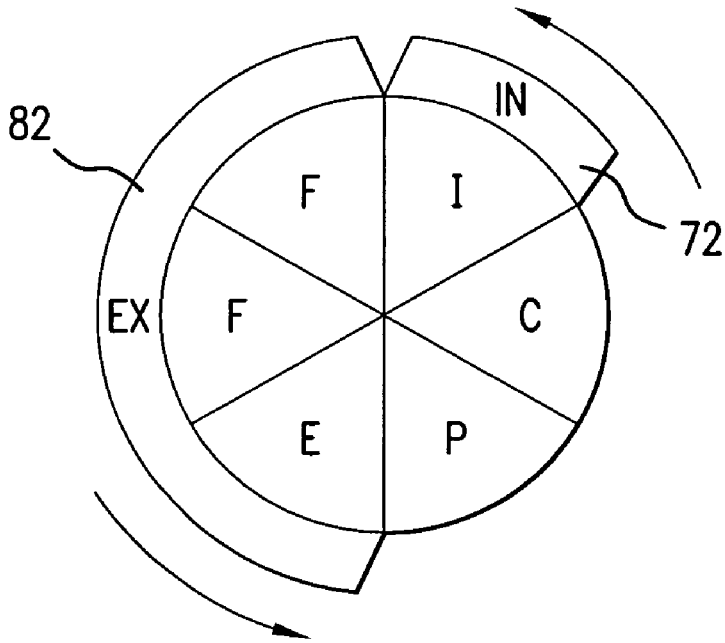
FIG. 6 is a side elevation of the camshaft and valve cams of FIG. 5, shown with rotation of this camshaft divided into sectors to indicate the intake and exhaust valve operation through the six cycles of intake, compression, power, exhaust and two free strokes as the camshaft rotates to move the intake and exhaust cam lobes in operative engagement with the valve lifters.

FIGS. 4-6 illustrate an example of a camshaft 60 used to operate the intake 30 and exhaust 40 valves of the cylinders between the closed position and open position. Specifically, an intake lobe 72 protruding from a side of an intake cam 70 on the camshaft 60 is structured to urge a pushrod 90 against a rocker arm 92 (or other member of a valve assembly) which moves the intake valve 30 open during the intake stroke. Continued rotation of the camshaft 60 causes the intake lobe 72 to relieve pressure on the pushrod 90 (or other structure of the valve assembly) so that the intake valve 30 and the exhaust valve 40 remain closed during a compression stroke and a power stroke. Thereafter, an exhaust lobe 82 protruding from a side of an exhaust cam 80 on the same camshaft 60 urges a pushrod 94 to move the rocker arm 96 and, in turn, to open the exhaust valve 40 through the exhaust stroke and both of the free strokes. The valve cams 70, 80 are specifically sized and rotated at a rate in accordance with the valve timing of the respective cylinder to coincide with each piston stroke of the six stroke cycle.

While the present invention has been shown and described in accordance with preferred and practical embodiments, it is recognized that departures from the instant disclosure are fully contemplated within the spirit and scope of the present invention which is not to be limited except as defined in the following claims as interpreted under the Doctrine of Equivalence.

What is claimed is:

1. An internal combustion engine comprising:

at least three cylinders each having a reciprocating piston moveable between a top dead center position and low dead center position in relation to a single variable volume combustion chamber defined between a head of the piston and a top of the cylinder;

the reciprocating piston in each of the cylinders being operable through a six stroke cycle including an intake stroke, a compression stroke, a power stroke, an exhaust stroke and two free strokes defined by reciprocating downward and upward movement of the piston during which there is no intake stroke, compression stroke or power stroke taking place within the cylinder;

an intake port on the top of the each of the cylinders for allowing injection of a fuel and air mixture into the single combustion chamber;

an intake valve operatively associated with each intake port and operable between an open position during the intake stroke to allow injection of the fuel and air mixture, and a closed position prior to the compression stroke in order to seal the intake port closed;

an exhaust port on the top of the each of the cylinders for allowing release of gases from combustion of the fuel and air mixture in the single combustion chamber;

an exhaust valve operatively associated with each exhaust port and operable between a closed position to seal the exhaust port closed and an open position throughout the exhaust stroke;

a clean air port and valve assembly operable from a closed position to an open position during the two free strokes; and the piston in any one of the cylinders being structured and disposed for operating through the power stroke while another of the pistons in another of the cylinders simultaneously operates through one of the free strokes.

2. The internal combustion engine as recited in claim 1 wherein the exhaust valve is structured and disposed to operate to the closed position during the intake stroke, the compression stroke, the power stroke, and the two free.

3. The internal combustion engine as recited in claim 2 wherein the clean air port and valve assembly of each of the cylinders is structured and disposed to operate to the closed position during the intake stroke, the compression stroke, the power stroke, and the exhaust stroke.

4. A method of operation of an internal combustion engine to provide increased efficiency of fuel consumption, said method comprising the steps of:

providing at least three cylinders each having a reciprocating piston with a single piston head moveable in relation to a single variable volume combustion chamber;

operating each reciprocating piston in each of the cylinders through a six stroke cycle including a single intake stroke, a single compression stroke, a single power stroke, an exhaust stroke, and two free strokes defined by reciprocating downward and upward movement of the piston during which there is no intake of fuel, compression or combustion within the cylinder;

opening an intake port of each of the cylinders during the intake stroke to allow injection of a fuel and air mixture into the combustion chamber;

closing the intake port during the compression stroke, the power stroke, the exhaust stroke, and the two free strokes;

opening an exhaust port of each of the cylinders during the exhaust stroke to allow release of gases from combustion of the fuel and air mixture in the combustion chamber;

opening a clean air port of each of the cylinders during the two free strokes with no injection of fuel, no compression and no combustion of fuel taking place in the cylinder; and whereby the piston in any one of the cylinders is structured and disposed to operate through the power stroke while another of the pistons in another of the cylinders simultaneously operates through one of the free strokes.

5. The method as recited in claim 4 comprising the further steps of:

operating the exhaust port to a closed position during the intake stroke, the compression stroke, the power stroke, and the two free strokes.

6. The method as recited in claim 5 comprising the further steps of:

operating the clean air port of each of the cylinders to the closed position during the intake stroke, the compression stroke, the power stroke, and the exhaust stroke for each respective one of the cylinders.

* * * * *